United States Patent [19]

Blackstone

[11] 4,315,534

[45] Feb. 16, 1982

[54] WOOD SPLITTER

[75] Inventor: George H. Blackstone, Toledo, Ohio

[73] Assignee: Arnold Industries, Inc., Toledo, Ohio

[21] Appl. No.: 168,480

[22] Filed: Jul. 14, 1980

[51] Int. Cl.[3] ..... B27L 7/00

[52] U.S. Cl. ..... 144/194; 74/15.63; 180/53 C; 254/104

[58] Field of Search ..... 144/193 R, 193 H, 194; 180/53 C; 254/104; 74/15.6, 15.63

[56] References Cited

U.S. PATENT DOCUMENTS

| | | | |
|---|---|---|---|
| 4,091,851 | 5/1978 | Ober | 144/193 R |
| 4,132,255 | 1/1979 | Thackery | 144/193 R |
| 4,211,265 | 7/1980 | Thackery | 144/194 |

FOREIGN PATENT DOCUMENTS

| | | | |
|---|---|---|---|
| 2814249 | 7/1979 | Fed. Rep. of Germany | 144/194 |
| 1120159 | 4/1956 | France | 144/193 |
| 1237200 | 6/1960 | France | 144/193 H |

*Primary Examiner*—W. D. Bray

*Attorney, Agent, or Firm*—Allen D. Gutchess, Jr.

[57] ABSTRACT

A wood splitter is provided particularly for splitting logs. The wood splitter is specifically designed for use with a power takeoff shaft and a three-point hitch of a tractor. The wood splitter includes a drive shaft comprising a hollow shaft and a rod-like strengthening member extending substantially therethrough. The rod-like member stops short of one end of the hollow shaft which is threaded and receives a threaded shank of a conical tip of the splitting cone. The other end of the rodlike member has a transverse bore which is aligned with diametrically opposite openings in the hollow shaft and through which a shear bolt extends to hold the rod-like member in a fixed longitudinal position relative to the hollow shaft. The wood splitter also has a main frame supported on two stabilizing bars extending from the frame to the ground. A supporting bar is slidably supported at the lower ends of the upright stabilizing bars and a bracing bar extends from the supporting bar in the same direction as the splitting cone.

10 Claims, 5 Drawing Figures

WOOD SPLITTER

This invention relates to a wood splitter for splitting logs and the like.

Wood splitters particularly recently have enjoyed tremendous popularity, with the energy situation. They are capable of splitting logs much more rapidly and with much less effort than with the sledge hammer and wedge technique heretofore employed. The rotary conical splitter embodying the invention is also much less expensive than the hydraulic splitters previously known.

The wood splitter in accordance with the invention is particularly designed for use with a power takeoff shaft and a three-point hitch of a tractor. The wood splitter includes a frame and arms which are mounted on the ends of the three-point hitch. The splitter also includes a drive shaft with end universal joints, one of which is connected to the power takeoff shaft and the other of which is connected to a drive shaft. The latter is rotatably supported by the splitter frame and extends into a splitting cone to turn the cone. The drive shaft includes a hollow or tubular shaft having a threaded outer end into which a threaded shank of a conical tip of the splitting cone is threaded. The drive shaft also includes a rod-like strengthening member which has one end terminating short of the threaded end of the hollow shaft. The other end of the rod-like member has a transverse bore which is aligned with diametrically opposite openings in the hollow shaft. A shear bolt extends through the bore and openings and through openings in one universal joint to connect the drive shaft thereto. The shear bolt thus can shear to prevent damage, and also serves to maintain the rod-like member in a fixed longitudinal position relative to the hollow shaft. The combined shaft appears to be stronger than a single solid shaft having an outer diameter equal to that of the hollow shaft.

The wood splitter also includes two upright stabilizing bars which extend through the frame on each side of the drive shaft and have lower ends supported on the ground. The frame and splitting cone can thus move upwardly somewhat relative to the ground in the event of jamming of logs being split. A supporting bar is slidably supported on the lower ends of the stabilizing bars and a bracing bar is affixed to an intermediate portion of the supporting bar and extends outwardly in the same direction as the cone, and parallel to the ground. This provides a solid brace for logs being split, particularly when the ground is soft. The bracing bar is supported at an angle relative to the stabilizing bars such that when the bracing bar is parallel to the ground, the drive shaft of the cone slants downwardly toward the ground and the lower peripheral surface of the cone is parallel to the ground. This minimizes the chance of a log being wedged between the cone and the ground as it is traveling up the cone and being split.

It is, therefore, a principal object of the invention to provide a wood splitter having the features and advantages discussed above.

Many other objects and advantages of the invention will be apparent from the following detailed description of a preferred embodiment thereof, reference being made to the accompanying drawings, in which.

Figure 1:
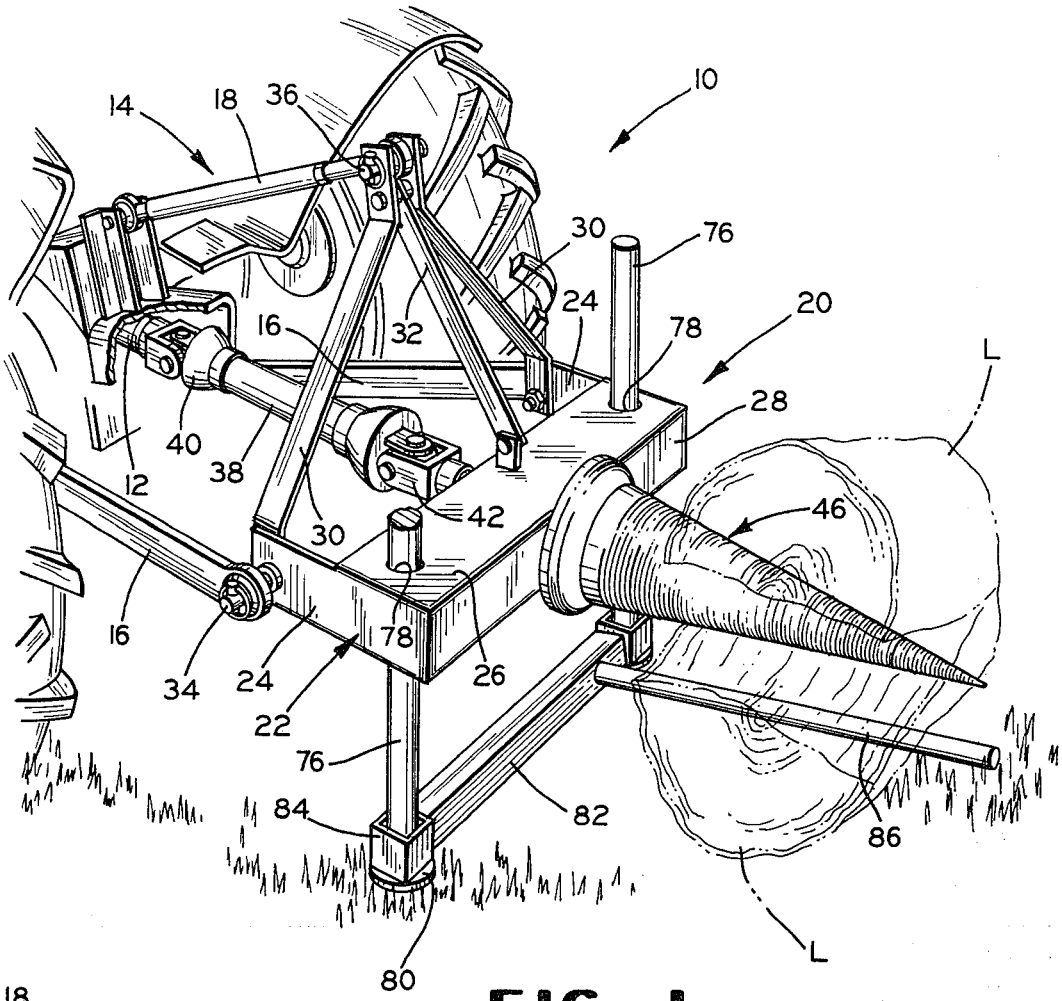
FIG. 1 is a fragmentary view in perspective of a tractor with a power takeoff shaft and a three-point hitch, and a wood splitter designed to be used therewith and embodying the invention.

Referring to FIG. 1, a tractor indicated at 10 includes a power takeoff shaft 12 and a three-point hitch 14. The hitch 14 includes two lower lift arms 16 and an adjustable top link 18. The lift arms 16 can be raised and lowered by hydraulic means (not shown) which can urge the lift arms downwardly but enable them to yield upwardly.

A wood splitter 20 embodying the invention is used to split a log L and is specifically designed to be used with a tractor having a power takeoff shaft and a three-point hitch. The wood splitter 20 includes a main frame 22 (FIG. 1–3) of box-like construction, including end walls 24, upper and lower walls 26, and side walls 28. Side arms 30 extend upwardly from ends of the end walls 24 while a center arm 32 extends upwardly from an intermediate portion of the upper wall 26. Outer ends of the lower lift arms 16 are connected to the ends of the end walls 24 through quick-release pins 34 while the outer end of the adjustable link 18 is connected to upper ends of the side arms 30 and the center arm 32 by a quick-release pin 36.

Figure 3:
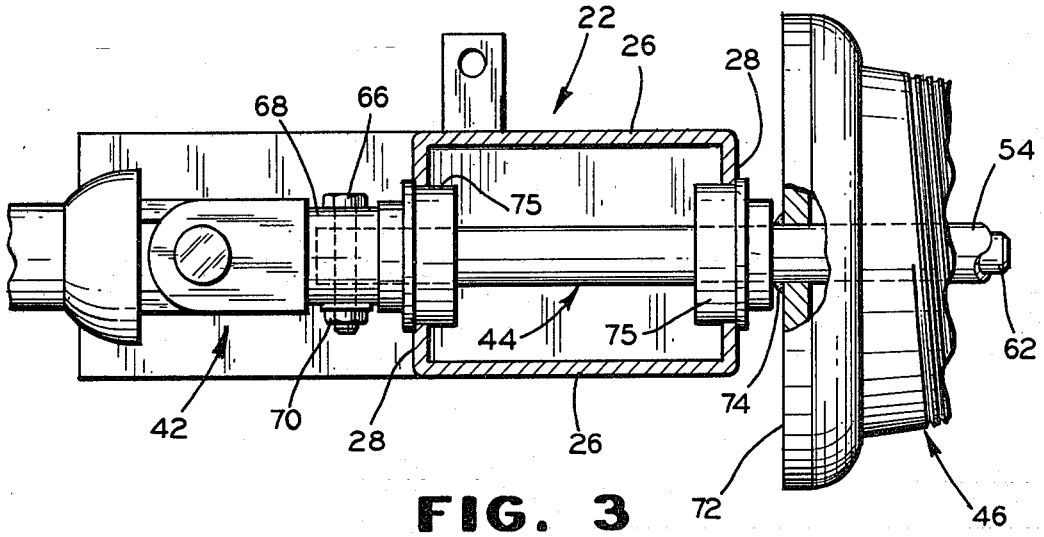
FIG. 3 is an enlarged, fragmentary view in longitudinal cross section taken through the splitter of FIG. 2.
Figure 4:
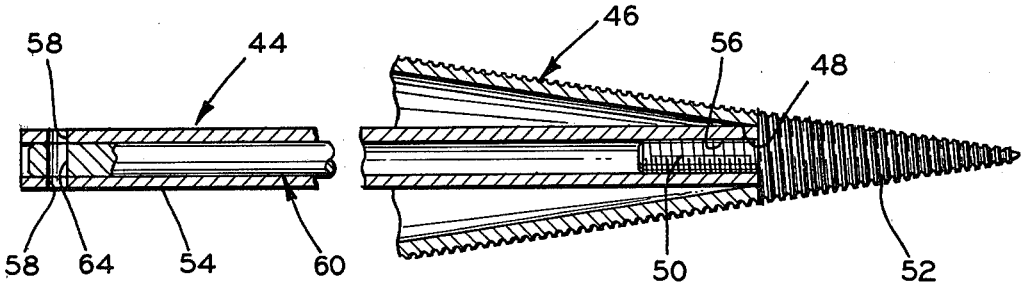
FIG. 4 is a fragmentary view in longitudinal cross section taken through a drive shaft and splitting cone of the splitter.

A connecting shaft 38 has a rear universal joint 40 connected to the power take-off shaft 12 and has a forward universal joint 42 connected to a drive shaft 44. The drive shaft 44 drives or rotates a splitting cone 46 which can be generally of the type shown in my U.S. Pat. No. 4,160,472 and will not be discussed in detail. The splitting cone 46 is truncated and has an open smaller end 48 (FIG. 4) into which a threaded shank 50 of a replacable conical tip 52 extends. The drive shaft 44 includes an outer hollow or tubular shaft 54 having a threaded end 56 into which the threaded shank 50 of the tip 52 is turned. The other end of the shaft 54 has diametrically-aligned openings 58 therein. An elongate, rod-like member 60 is located in the hollow shaft 54 and has an outer diameter similar to the inner diameter of the shaft 54. The rod-like member 60 has an end 62 which terminates inside of the cone 46 and well short of the threaded end 56 of the shaft 54 and the threaded shank 50 of the conical tip 52. The opposite end of the rod-like member 60 has a transverse bore 64 which is aligned with the shaft openings 58. The rod-like member 60 is held in a fixed longitudinal position relative to the shaft 54 by a shear bolt 66 (FIG. 3) which extends through the openings 58 and the bore 64 and also through a sleeve 68 of the universal joint 42 to connect the drive shaft 44 to the connecting shaft 38. The bolt 66 is held in place by a nut 70 and can shear to disconnect the universal joint 42 from the drive shaft 44 if jamming should result. The shaft 54 of the drive shaft 44 extends through a back plate 72 of the splitting cone 46 and is affixed thereto by the weld metal 74. The shaft 54 is also rotatably supported by bearings 75 located in the side walls 28 of the main frame 22. The rod-like member 60 is of heat-treated, high carbon alloy steel for additional strength.

Upright stabilizing bars 76 extend through aligned openings 78 in the upper and lower walls 26 of the main frame 20. The lower ends of these bars have enlarged heads 80 which rest upon the ground. The bars 76 provide stabilization for the main frame 20 but enable the frame 20 to move relative to the ground, in case of jamming of the log L. The frame 20 is urged downwardly by the three-point hitch but the hitch also enables the main frame to yield upwardly when sufficient force is encountered. Since the stabilizing bars 76 need not be driven into the ground, but simply rest thereon, there is no problem as has heretofore been encountered with frozen ground, rocky soil, pavement, and the like.

Figure 2:
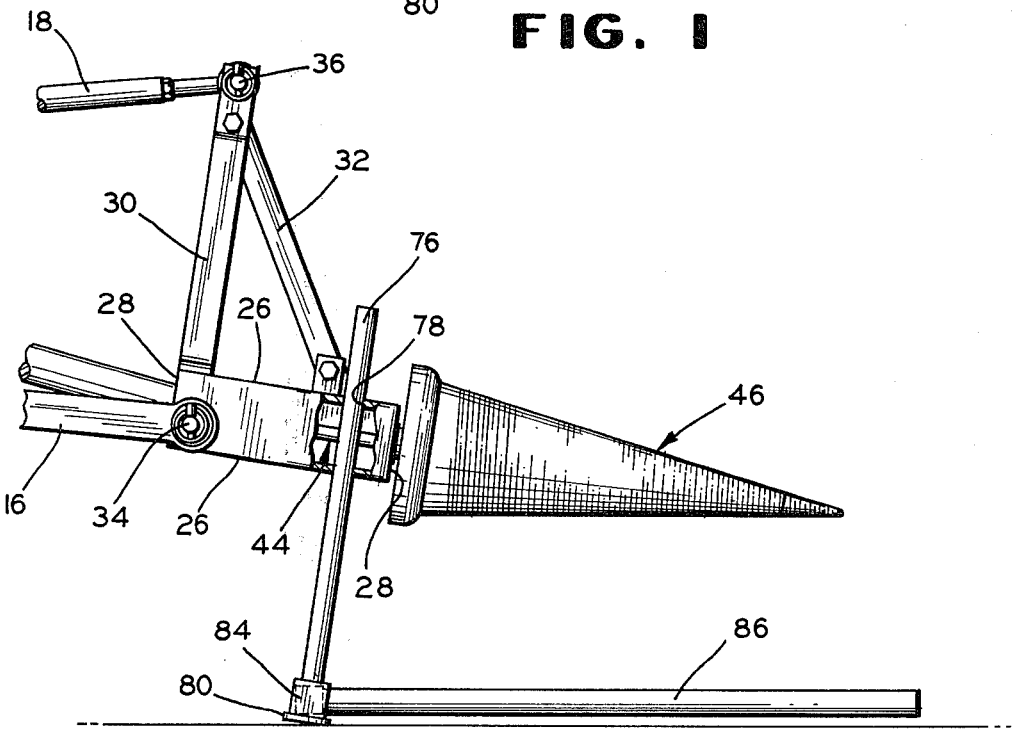
FIG. 2 is a somewhat schematic side view in elevation, with parts broken away and with parts in section, of the wood splitter and a portion of the tractor of FIG. 1.

A supporting bar 82 of square transverse cross section extends between the stabilizing bars 76 and is connected thereto by short transverse sleeves 84 which can also be square in transverse cross section. A bracing bar 86 is affixed to a face of the supporting bar 82 and extends in the same direction as the cone 46, preferably extending somewhat beyond the outer end thereof. The bracing bar 86 rests on the ground and is at an angle to the drive shaft 44 of the splitter. This is designed so that the lower periphery of the splitting cone 46 will be substantially parallel to the ground, as shown in FIG. 2. With this arrangement, it is unlikely that a log being split can jam between the cone 46 and the ground as it is carried along the cone during rotation thereon.

Figure 5:
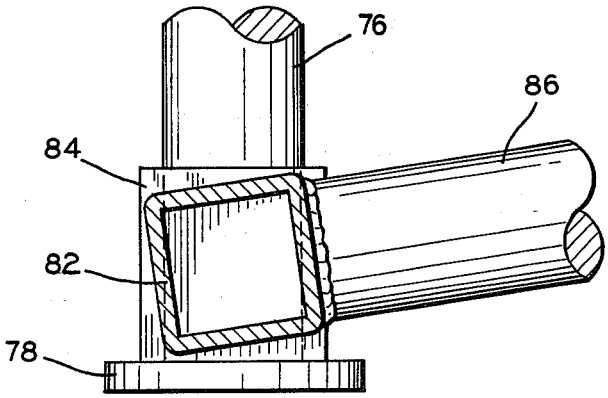
FIG. 5 is a further enlarged, detailed view of a stabilizing bar, supporting bar and bracing bar of the splitter.

To accomplish the above, the supporting member 82 is affixed to the sleeves 84 at angles, as shown in FIG. 5. The angular relationship is such that when the bracing bar 86 is parallel to the ground, the stabilizing bar 76 will be at an angle to the vertical which is half the included angle of the splitting cone. Specifically, where the included angle of the splitting cone is 17° 10′, the stabilizing bars 76 will be at an angle of 8° 35′ to the vertical. Hence, when the lower periphery of the splitting cone 46 is parallel to the ground, the drive shaft 46 will form an angle of 8° 35′ to the ground. The bracing bar 86 thus is effective to prevent shorter logs in particular from spinning with the cone 46 which can occur more often when the ground is soft. At the same time, the bracing bar 86 is firmly backed up by and supported on the ground.

Various modifications of the above described embodiment of the invention will be apparent to those skilled in the art and it is to be understood that such modifications can be made without departing from the scope of the invention, if they are within the spirit and the tenor of the accompanying claims.

I claim:

1. A wood splitter comprising a splitter cone of generally truncated conical shape having an opening at its smaller end, a conical tip having a threaded shank extending through said opening, a hollow shaft extending into said splitter cone from the larger end thereof, said hollow shaft having an internally-threaded end into which said threaded shank is threaded, a rod-like elongate member in said hollow shaft, said rod-like member having an outer diameter similar to the inner diameter of said hollow shaft to fit closely therewith, said rod-like member having one end terminating short of said threaded shank, and having another end terminating outside said splitter member near the outer end of said hollow shaft, and means for maintaining said rod-like member in a fixed longitudinal position relative to said hollow shaft and for causing said rod-like member and said sleeve to rotate together.

2. A wood splitter according to claim 1 wherein said last-named means comprises aligned openings in said hollow shaft and in said rod-like member, and pin means extending through said aligned openings.

3. A wood splitter according to claim 2 wherein said hollow shaft has a universal joint yoke affixed to the outer end thereof with said pin means extending through said yoke in addition to said hollow shaft and said rod-like member.

4. A wood splitter comprising a splitter cone, a drive shaft for said splitter cone, a frame supporting said drive shaft, two upright members extending through said frame in slideable relationship with respect thereto and extending downwardly to the ground from said frame, a horizontal supporting member extending between lower ends of said upright members, and a bracing bar having an end affixed to said horizontal member and extending outwardly therefrom in the same direction as said splitter cone, said frame being moveable upwardly and downwardly relative to said bracing bar and the ground.

5. A wood splitter according to claim 4 characterized by a lower periphery of said splitter cone being positioned substantially parallel to the ground and said bracing bar being substantially supported on the ground.

6. A wood splitter according to claim 5 characterized by said horizontal supporting member having tubular end portions through which said upright members extend, said horizontal member having a substantially vertical surface positioned at an angle relative to said upright members with said bracing bar extending horizontally therefrom, perpendicular to said vertical surface.

7. A wood splitter according to claim 6 wherein said angle is substantially equal to one-half the included angle of said splitter cone.

8. A wood splitter according to claim 4 wherein said drive shaft comprises a hollow elongate shaft and an elongate rod-like member in said hollow shaft.

9. A wood splitter according to claim 8 wherein said splitter cone has a separate conical end with a threaded shank and said hollow shaft has an internally threaded end into which said shank is threaded.

10. A wood splitter according to claim 8 wherein said hollow shaft has diametrically-opposite, aligned openings therein and said rod-like member has a transverse opening therein aligned with said shaft openings, a universal joint yoke affixed to the outer end of said hollow shaft, said yoke having openings aligned with said shaft openings and said transverse opening, and shear pin means extending through said openings in said yoke and through said openings in said hollow shaft and in said rod-like member, whereby said shear pin means can shear to enable said universal joint yoke to rotate separately from said hollow shaft and said rod-like member.

* * * * *